US011852332B1

(12) United States Patent
Anderson et al.

(10) Patent No.: US 11,852,332 B1
(45) Date of Patent: Dec. 26, 2023

(54) SYSTEMS AND METHODS FOR WIRED LIGHTING FOR A SPA

(71) Applicant: BULLFROG INTERNATIONAL, LC, Herriman, UT (US)

(72) Inventors: Todd Anderson, Lehi, UT (US); Eric Hales, Eagle Mountain, UT (US)

(73) Assignee: Bullfrog International, LC, Herriman, UT (US)

( * ) Notice: Subject to any disclaimer, the term of this patent is extended or adjusted under 35 U.S.C. 154(b) by 0 days.

(21) Appl. No.: 17/983,964

(22) Filed: Nov. 9, 2022

(51) Int. Cl.
*F21V 33/00* (2006.01)
*F21W 131/401* (2006.01)

(52) U.S. Cl.
CPC ..... *F21V 33/008* (2013.01); *F21W 2131/401* (2013.01)

(58) Field of Classification Search
CPC ..... F21V 33/008; F21W 2131/401
See application file for complete search history.

(56) References Cited

U.S. PATENT DOCUMENTS

D426,309 S * 6/2000 Magray ..... D24/204
6,375,342 B1 * 4/2002 Koren ..... B05B 17/085 239/18
9,062,839 B1 * 6/2015 Elder ..... F21S 8/03
10,221,583 B1 * 3/2019 Elder ..... F21V 31/005
10,315,214 B2 * 6/2019 Vogtner ..... F21S 8/00
2002/0074420 A1 * 6/2002 Koren ..... B05B 17/085 239/18
2008/0101054 A1 * 5/2008 Scali ..... E04H 4/148 4/496
2014/0117107 A1 * 5/2014 Vogtner ..... F21S 8/00 239/18
2017/0072423 A1 * 3/2017 Vogtner ..... F21S 10/02

FOREIGN PATENT DOCUMENTS

CA 3002839 C * 7/2020 ..... B05B 1/1618

* cited by examiner

*Primary Examiner* — Leah Simone Macchiarolo
(74) *Attorney, Agent, or Firm* — Dentons Durham Jones Pinegar; Sarah W. Matthews; Lilly Godfrey

(57) ABSTRACT

This disclosure relates generally to spa waterfall lighting systems. A spa waterfall lighting system can include a waterfall body with a base portion and a top portion, and a wired light located within the waterfall body. A projection, coupling, or barb is in connection with the base portion of the waterfall body. The projection includes an externally threaded portion, with a channel formed in the externally threaded portion. The channel receives a wire, the wire in electrical connection with the wired light located within the waterfall body. A threaded nut secures the projection to a spa shell, and the threaded nut is threadable over the externally threaded portion of the projection when the wire is in the channel.

20 Claims, 5 Drawing Sheets

SYSTEMS AND METHODS FOR WIRED LIGHTING FOR A SPA

TECHNICAL FIELD

This disclosure relates generally to spas. More specifically, this disclosure relates to providing electricity for spa parts, such as lighting for spa parts.

SUMMARY

In various aspects, systems and methods are provided for a spa waterfall lighting system including a waterfall body with a base portion and a top portion, an inlet for receiving water and an outlet for dispersing water into a spa shell cavity. The waterfall body further includes a wired light located within the waterfall body. The system also includes a projection in connection with the base portion of the waterfall body, where the projection includes a hollow lumen in fluid communication with the inlet of the waterfall body. The projection further includes an externally threaded portion and a channel formed in the externally threaded portion, where the channel is for receiving a wire in electrical connection with the wired light located within the waterfall body. The system further includes a threaded nut for securing the projection to a spa shell, and the threaded nut is threadable over the externally threaded portion of the projection when the wire is in the channel. Additionally, the system includes a selectively removable cover to cover a portion of the top portion of the waterfall body.

In some embodiments, the projection includes a smooth barb coupling for attaching the projection to a water source.

In some embodiments, the channel is open on an external side of the channel to insert the wire into the channel. In other embodiments, the channel is covered on an external side.

According to another aspect, the inlet for receiving water is in fluid communication with the projection, such that water flows from the projection, through the inlet of the waterfall body, and to the outlet for dispersing water into the spa shell cavity.

According to another aspect, the base portion of the waterfall body includes a lighting conduit formed in a bottom side of the base portion, with the lighting conduit extending upwardly from the base portion and forming a space to receive the wired light.

In some embodiments, the top portion of the waterfall body forms a spillway on a top side of the top portion. The top portion of the waterfall body may include a void therethrough to allow water to pass from an interior of the waterfall body, through the void, and onto the spillway. Even more specifically, the top portion of the waterfall body can include a plurality of voids therethrough to allow water to pass from an interior of the waterfall body, through the void, and onto the spillway. The top portion may further include a plurality of upwardly extending dividers separating each of the plurality of voids.

According to another aspect, removing the selectively removable cover exposes the waterfall body to access the waterfall body for maintenance.

According to another aspect, the projection can be configured to extend through an aperture in the spa shell, from a top side of the spa shell to a bottom side of the spa shell, to connect the waterfall body to the spa shell. The threaded nut may secure the projection to the bottom side of the spa shell. In some embodiments, the projection is integral to the base portion of the waterfall body.

According to another aspect, a system for attaching a wired feature to a spa shell can include a coupling in connection with a bottom side of a body of the wired feature, where the coupling is for extending through an aperture in the spa shell to connect the body of the wired feature to the spa shell. The coupling may inlcude an externally threaded portion, and a channel formed in the externally threaded portion. The channel may be for receiving a wire, and the wire may be in electrical connection with a wired element located within the body of the wired feature. The system may also include a threaded nut for securing the coupling to the bottom side of the spa shell, where the threaded nut is threadable over the externally threaded portion of the coupling when the wire is in the channel.

According to another aspect, a spa waterfall lighting system includes: a waterfall body with a base portion and a top portion, an inlet for receiving water and an outlet for dispersing water into a spa shell cavity. The top portion of the waterfall body may form a spillway on a top side of the top portion, with the top portion of the waterfall body further including a void therethrough to allow water to pass from an interior of the waterfall body, through the void, and onto the spillway. The system may also include a selectively removable cover to cover a portion of the top portion of the waterfall body, where removing the selectively removable cover exposes the void to allow a user to service the spa waterfall lighting system.

According to another aspect, a method is described for providing a wired connection to a light within a waterfall feature. The method may include providing the waterfall feature, the waterfall feature having a waterfall body with an inlet for receiving water and an outlet for dispersing water into a spa shell cavity, and a wired light located within the waterfall body. The waterfall body may further include a coupling in fluid communication with the waterfall body, the coupling for receiving water therethrough. The coupling may have an externally threaded portion and a channel formed in the externally threaded portion, where the channel is for receiving a wire, which may be in electrical connection with the wired light located within the waterfall body. The method may also include placing the wire through the channel, from a power source to the wired light; placing the coupling through a void in a spa shell, and securing a threaded nut for over the externally threaded portion of the coupling when the wire is in the channel.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
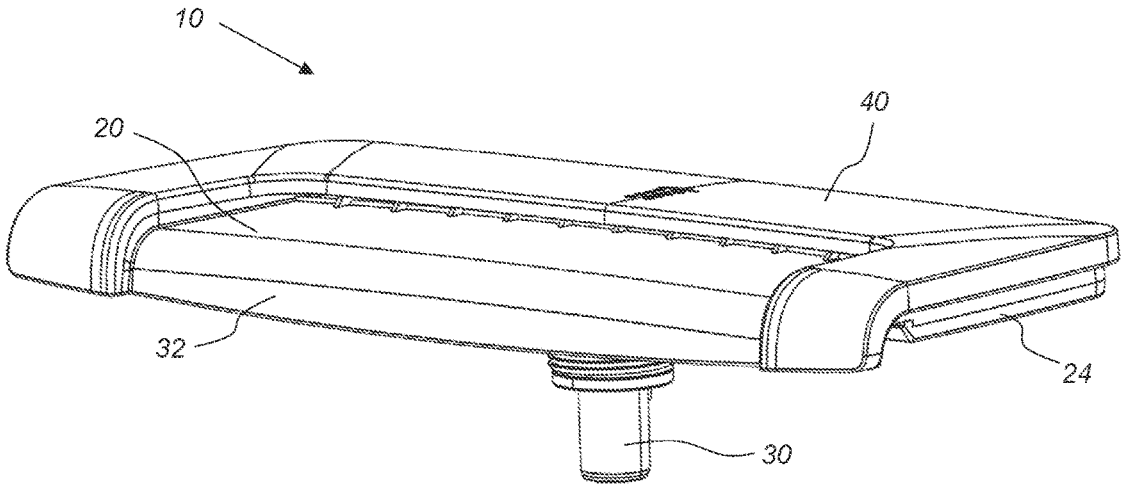
FIG. 1 provides a perspective front view of an embodiment of a spa waterfall lighting system according to this disclosure.
Figure 2:
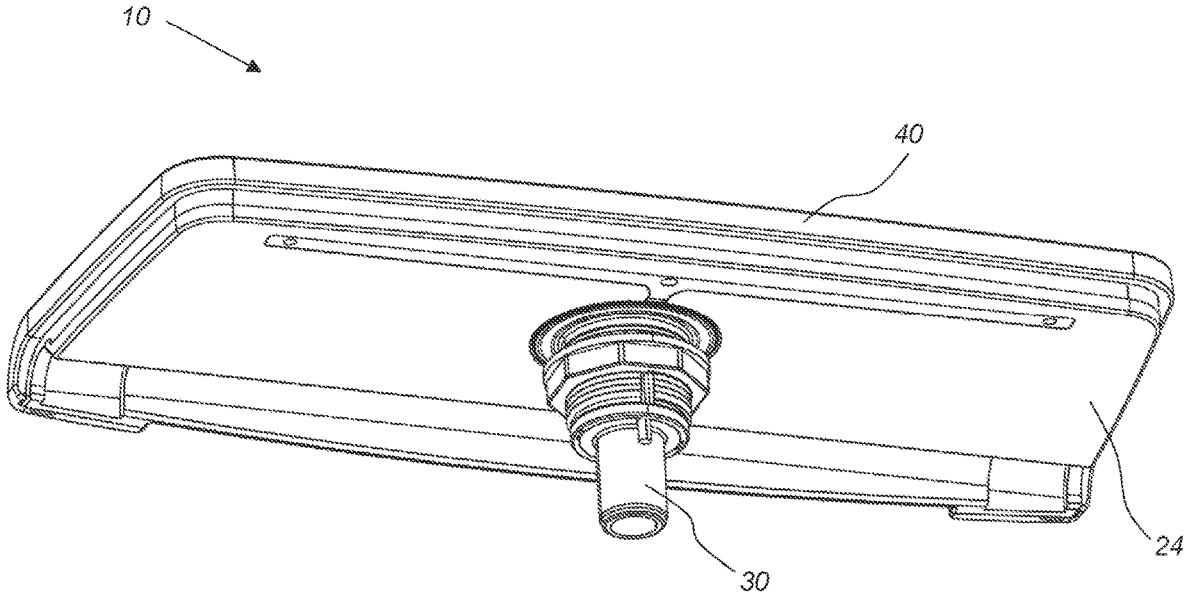
FIG. 2 provides a rear perspective view of the embodiment of the spa waterfall system shown in FIG. 1.

FIGS. 1-4 illustrate an embodiment of a spa waterfall lighting assembly or spa waterfall lighting system 10. In this embodiment, the system 10 includes a waterfall body 15 with a top 20 and a base 24. An inlet 28 is formed in the waterfall body 15 for receiving water, and an outlet 32 is provided for dispersing water into the spa, or into the spa shell cavity. A projection 30, such as a barb, is in connection with the base portion 24 of the waterfall body 15 to connect the waterfall body 15 to the spa shell 47. A wired light (not visible in FIG. 1) is also located within the waterfall body 15. In some embodiments, the spa waterfall lighting system 10 includes a selectively removable cover 40 to cover at least a portion of the top portion 20 of the waterfall body 15. A gasket 41 can be placed between the removable cover 40 and the top 20 of the waterfall body 15.

The waterfall body 15 can be formed of a base portion 24 and/or a top portion In some embodiments, the base portion 24 and top portion 20 can be formed integrally, and, in other embodiments, they are formed separately and connected to form the waterfall body 15.

The base portion 24 of the waterfall body 15 includes projection, coupling, tube, or barb Projection or tube 30 extends downwardly from the base portion 24, and in some embodiments has a hollow lumen or interior channel 35. That is, the projection 30 may define the hollow lumen or interior channel 35 within the projection 30. Projection 30 can be, for example, a smooth barb coupling, or another coupling for attaching the projection 30 to a water source. Projection 30 can be in fluid communication with an inlet 28 of the waterfall body 15, such that water can flow from a water source, through the hollow lumen 35 of the projection (such as a coupling, etc.) 30, and into the inlet 28 of the waterfall body 15. For example, water can flow from a spa, through the hollow lumen or interior channel 35 of the projection 30, into the inlet 28, and out of the outlet 32 of the waterfall body 15. The interior channel 35, the inlet 28, and the outlet 32 may all be in fluid communication with one another. From the waterfall body water passes to the outlet 32 to disperse water into the spa shell cavity. Projection 30 can be formed integral to the waterfall body 15, or can be connected to the waterfall body 15.

In some embodiments the projection 30 includes an externally threaded portion 44. The externally threaded portion 44 is typically placed below a spa shell 47 when the waterfall body 15 is installed onto a spa shell 47. For example, the projection 30 may extend through an aperture in a spa shell 47, from a top side 51 of the spa shell 47 to a bottom side 53 of the spa shell 47, to connect the waterfall body 15 to the spa shell 47. The externally threaded portion 44 can be at least partially below the bottom side 53 of the spa shell 47, allowing the threaded nut 58 to secure the projection 30 to the bottom side 53 of the spa shell 47. In some embodiments, a gasket 62 can also be provided, the gasket 62 for placement between a bottom side 53 of the spa shell 47 and the threaded nut 58.

Figure 5:
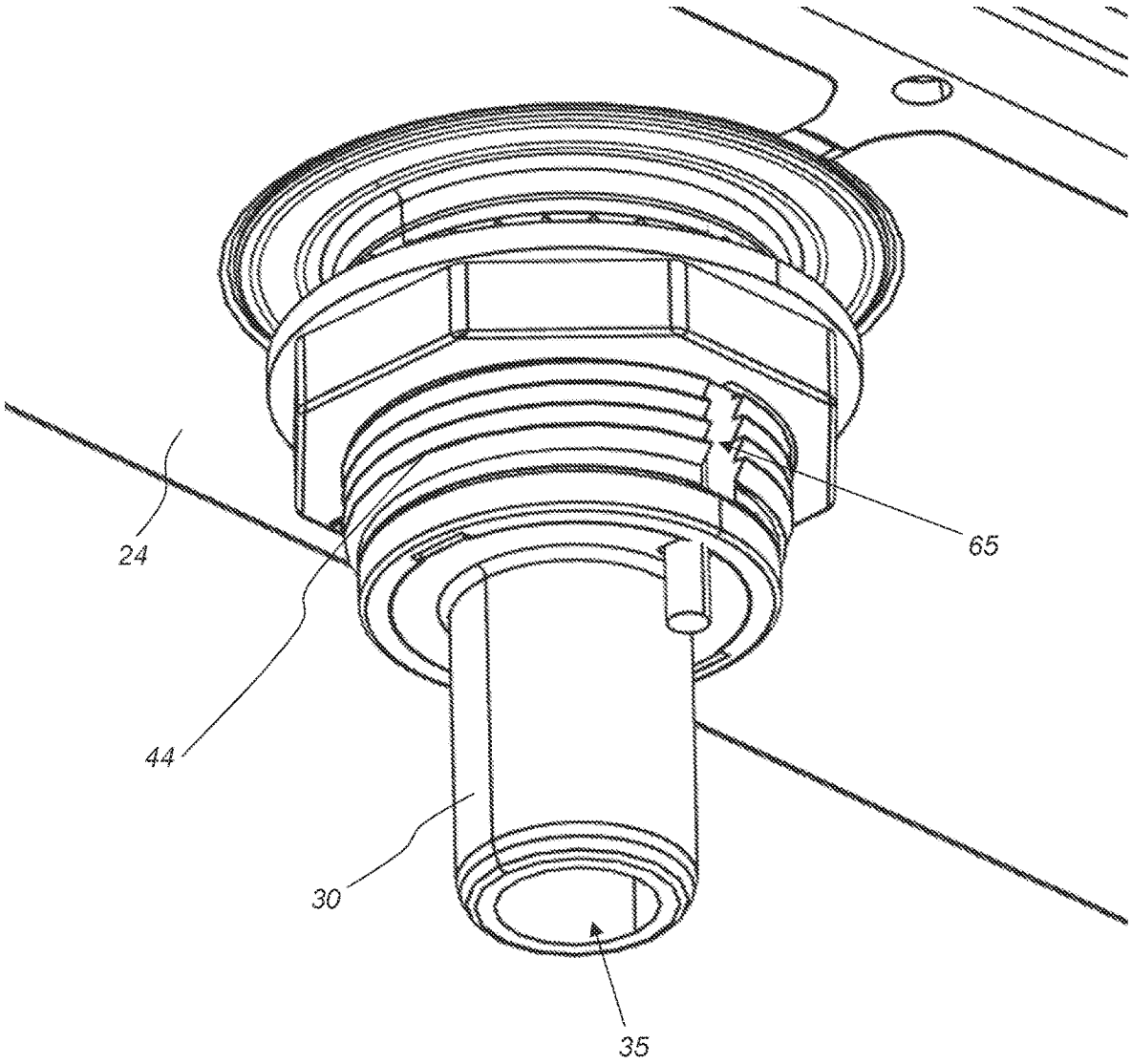
FIG. 5 provides a close-up view of a bottom portion of a body of the spa waterfall lighting system.

In some embodiments, the externally threaded portion 44 of the projection 30 has a channel 65 formed therein (best seen in FIG. 5). The channel 65 is for receiving a wire. The wire can be in connection with any wired element located in the waterfall body 15 or proximal to the waterfall body 15. The wire can provide power to any electrical element needed. For example, a wired light 70 located within the waterfall body 15 can be in electrical connection with the wire placed in the channel 65 (see FIG. 4).

In some embodiments, the channel 65 is open on an external side of the channel 65 to insert the wire into the channel 65. The channel 65 may be sized and shaped in any suitable size and shape desired. In some embodiments the channel 65 is sized to fit a wire. For example, the channel 65 can be sized to friction fit a wire, such that the wire can be pressed into the channel 65 (such as pressed in from an open external side). In other embodiments, the channel is covered on an external side.

The channel 65 can allow a wire to extend from a wired element (such as a wired light 70) within the body 15 of the waterfall system 10, through the channel 65 in the externally threaded portion 44 of the projection 30, and to a power source. This can be done without the need for drilling a separate hole for the wire. The threaded nut 58 may be threadable over the externally threaded portion 44 of the projection 30 when the wire is in the channel 65. Similarly, a gasket 62 can also be placed over the externally threaded portion 44 when the wire is in the channel 65. The aperture created in the spa shell 47 for the projection 30 can serve as an aperture for the wire as well, with a safe separation between the wire and the hollow lumen 35 or coupling for receiving water.

Figure 6:
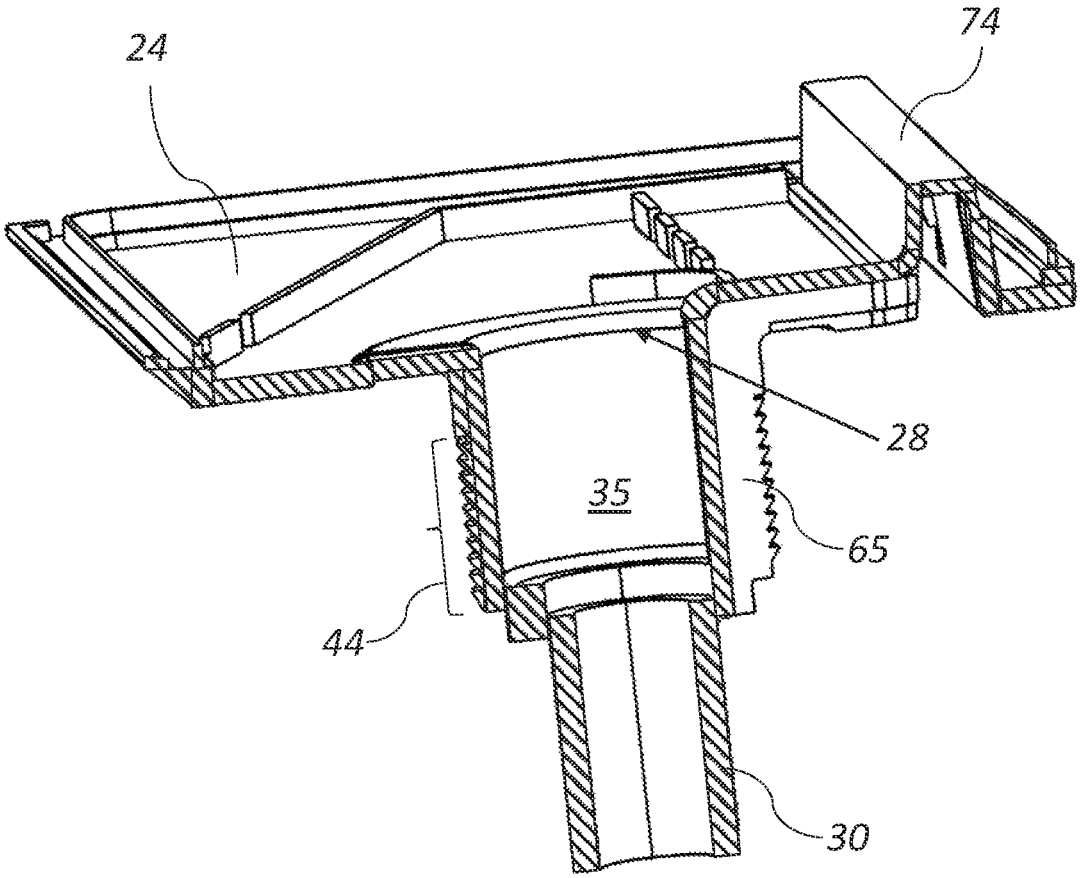
FIG. 6 provides a perspective cross-sectional view of an embodiment of a base of a waterfall body.

In some embodiments, the base portion 24 of the waterfall body 15 can also include a structure for receiving the wired light 70 within the waterfall body 15. For example, the base portion 24 can include a lighting conduit 74 (best seen in FIG. 6) formed in a bottom side of the base portion 24, the lighting conduit 74 extending upwardly from the base portion 24 and forming a space to receive the wired light 70. The lighting conduit 74 can be formed of optically clear material such that the wired light 70 can be seated and protected within the lighting conduit 74, and still shine through the waterfall body 15. Depending on the desired lighting effects, optically clear, optically transparent, and/or optically translucent materials can be used to form the lighting conduit 74. In some embodiments, the base 24 of the waterfall body 15 is formed integral to the lighting conduit 74 and the base 24 of the waterfall body 15 is formed of optically clear or optically transparent or translucent materials. In other configurations, a lighting conduit 74 is not provided.

Figure 3:
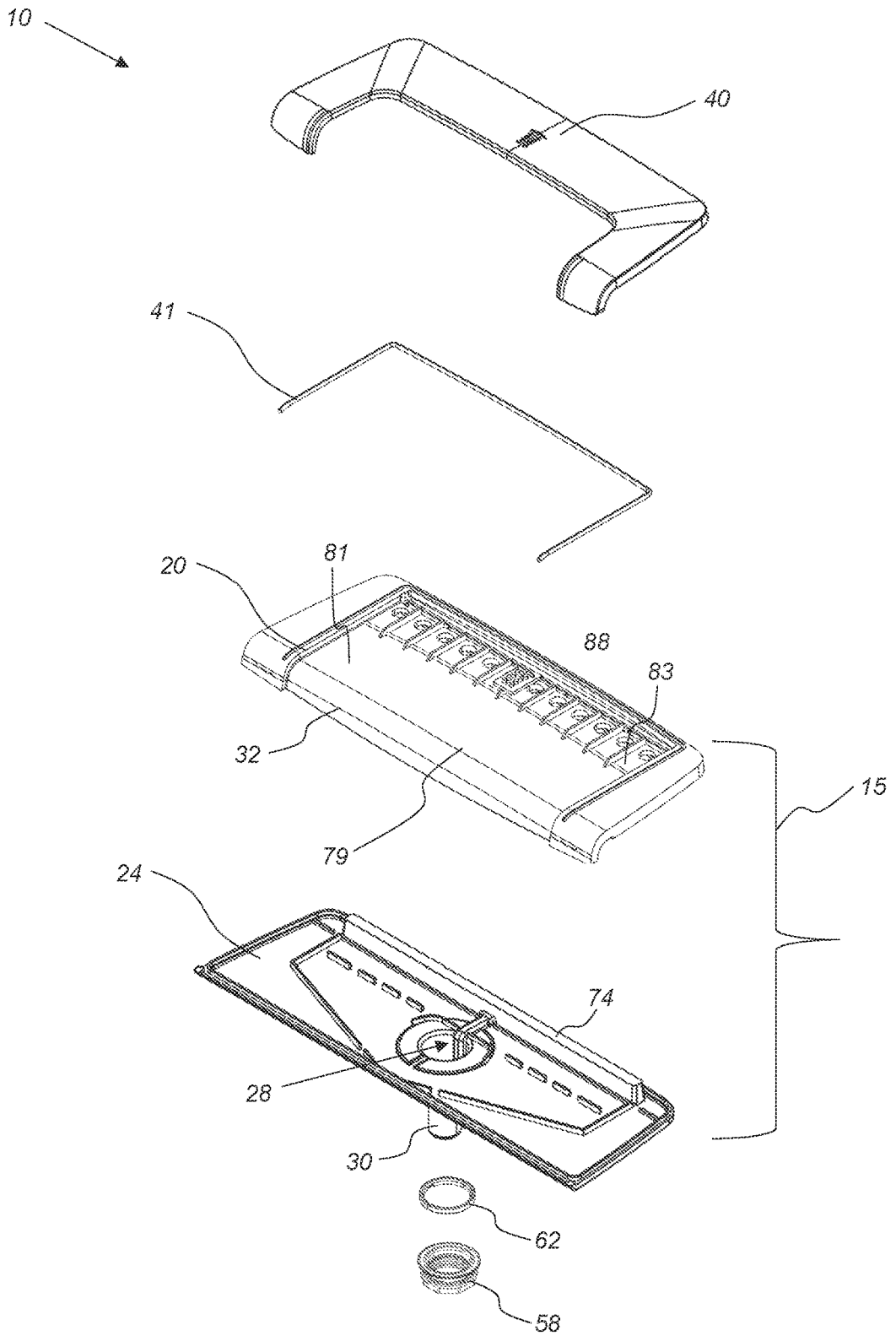
FIG. 3 provides an exploded view of the embodiment of the spa waterfall lighting system shown in FIG. 1.
Figure 4:
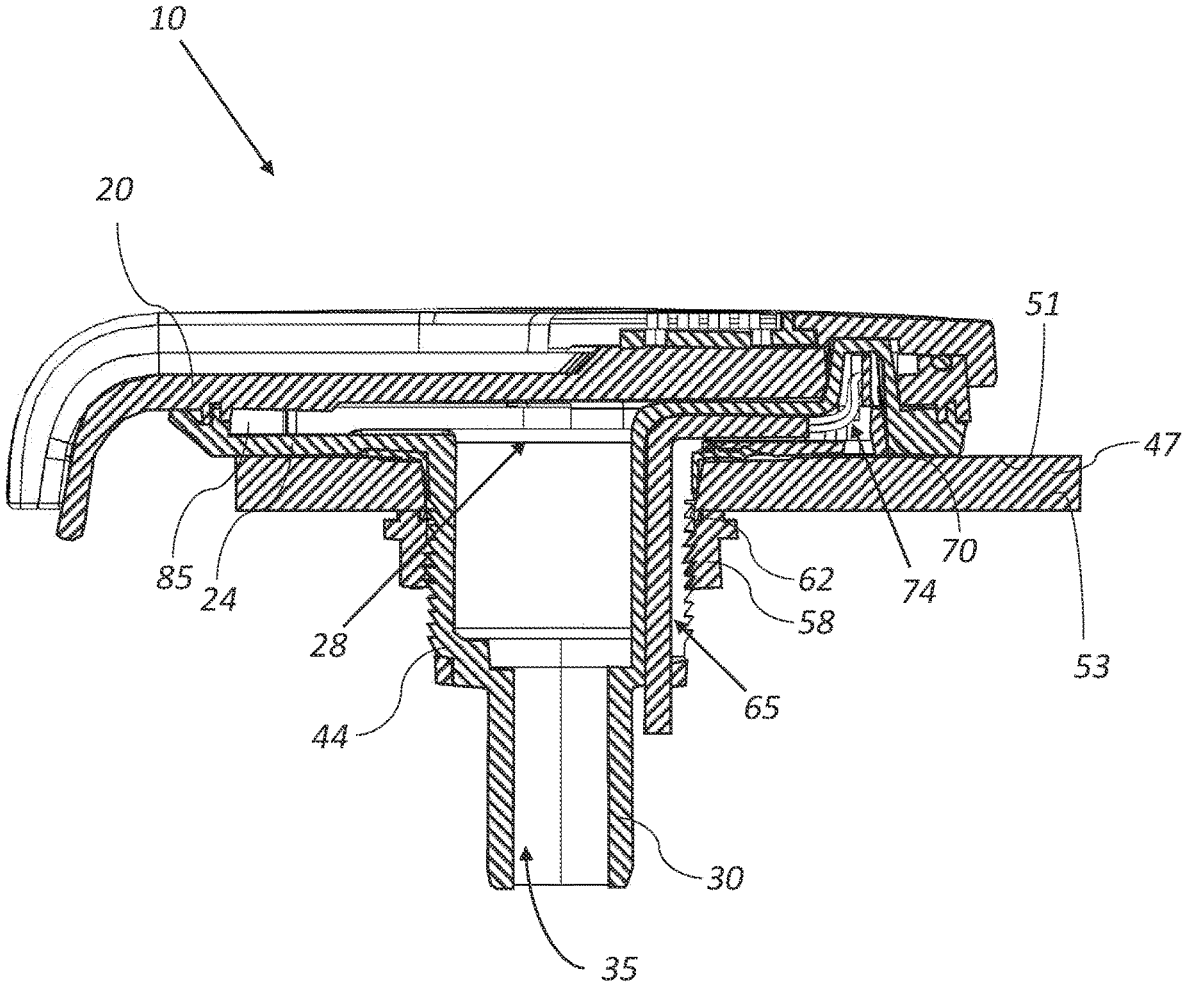
FIG. 4 provides a cross-sectional view of the embodiment of the spa waterfall lighting system shown in FIG. 1.

With reference to FIG. 3, the top portion 20 of the waterfall body 15 includes an outlet 32 in fluid communication with a spa shell cavity, such that water can flow from the waterfall body 15 and to the outlet 32 to disperse water into the spa shell cavity. The top portion 20 can form a spillway 79 on a top side 81 of the top portion 20. The top portion 20 of the waterfall body 15 comprises a void 83 therethrough to allow water to pass from an interior 85 of the waterfall body 15, through the void 83, and onto the spillway 79. In some embodiments, a single void 83 is provided. In other embodiments, two, three, four, five, or more voids 83 are provided. In the embodiment shown in FIG. 3, twelve voids 83 are provided. More or fewer voids 83 can be provided to achieve the desired water effects. The shape, size, and placement of the voids 83 can be selected based on desired water flow effects.

In some configurations, the top portion 20 includes one or more structures to achieve the desired water flow effects or water fall effects. For example, the top portion 20 can include one or more upwardly extending dividers 88 on the top side 81 of the top portion 20. The dividers 88 can separate each of the voids 83 to provide desired water flow effects over the spillway 79. Fewer or more dividers 88 can be used. The length, placement, shape, and number of dividers 88 can be selected based on the desired water flow effects.

In some embodiments a waterfall system 10 includes a selectively removable cover 40. The cover 40 can cover at least a portion of the top portion 20 of the waterfall body 15. In other embodiments, a selectively removable cover 40 is not provided. Where a cover 40 is provided, the cover 40 may be a functional cover for the waterfall body 15. That is, removal of the cover 40 can expose at least a portion of the waterfall body 15.

In some embodiments, removal of the cover 40 exposes the void(s) 83 of the waterfall body 15. This can allow a user to access the void(s) 83 of the waterfall body 15 to service the voids 83, ensure there is no blockage, etc., by simply removing the cover 40. This is in contrast to other known spa waterfall systems that typically do not provide a removable cover 40 to service the waterfall body 15.

The spa waterfall system 10 as described herein incorporates a wired light 70 directly into the body 15 of the waterfall system 10. The wired light 70 may be placed in any position desired within the body 15 of the waterfall feature. This is in contrast to many prior art waterfall features, which require that the light is not directly within the body of the waterfall feature, but rather connected to the bottom of a clear element that is installed through the acrylic shell. By relying on transmission of the light through the clear element, the desired lighting effect is not always achieved. For example, the light may not be as bright due to indirect lighting, etc. Additionally, the method of using lights connected to a clear element requires several holes to be drilled through the spa shell, increasing the potential for leaks. Drilling additional holes also adds to time and complexity of the manufacturing process.

To install the present spa waterfall lighting system 10, only a single aperture or void in the spa shell 47 is required for connecting the waterfall body 15 to the shell 47, and all lighting. The aperture is typically drilled through the spa shell 47, from a top side 51 of the spa shell 47 to a bottom side 53 of the spa shell 47, at a location such as an edge or lip of the spa shell 47, next to the cavity of the spa shell 47. This can allow the waterfall feature, when installed through lip of the spa shell 47, proximal to the cavity, to have water disperse from the waterfall feature into the spa shell cavity.

After the void or aperture is formed in the spa shell 47, the waterfall lighting feature can be fed or placed through the aperture. The wire of the wired light 70 may first be fed through the aperture, and then placed within the channel 65 of the threaded portion 44 of the projection or coupling 30. With the projection or coupling 30 positioned through the aperture, the body 15 of the waterfall feature sits at the top side 51 of the spa shell 47, and the projection or coupling 30 extends through the aperture, with at least a portion of the threaded portion 44 of the projection 30 extending past the bottom side 53 of the spa shell 47. This threaded portion 44 that extends past the bottom side 53 of the spa shell 47 allows a threaded nut, gasket 58, etc. to be threaded onto the threaded portion 44 to hold the waterfall system 10 into place on the spa shell 47.

In other configurations, the projection 30 is used to couple other wired elements to the spa shell 47. For example, a wired feature having a body can be coupled to the spa shell. In one embodiment, a system for attaching a wired feature to a spa shell can include a coupling in connection with a bottom side of a body of the wired feature. The coupling may extend through an aperture in the spa shell to connect the body of the wired feature to the spa shell. The coupling can include an externally threaded portion, with a channel formed in the externally threaded portion. The channel may receive a wire, with the wire in electrical connection to a wired element located within the body of the wired feature. A threaded nut can be used to secure the coupling to a bottom side of the spa shell. The threaded nut is threadable over the externally threaded portion of the coupling when the wire is in the channel. In some embodiments the wired element is a wired light, a wired user interface, a wired display, etc. The coupling may be integral to the body of the wired feature, or attached separately. The wired feature can include any feature of the spa, such as a waterfall, a jet body, an air valve, a diverter valve, a pillow, or any other component that may typically pass through a spa shell.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular water-containing vessel (e.g., a spa); however, other vessels (e.g., pools, tubs, swim spas, etc.) are also contemplated. A spa is also known in the industry as a hot tub and is generally formed of a concave shell to receive and contain water. Structures, such as a jet, can extend through the concave shell to move water from a surface outside the spa to a surface inside the spa or shell. Surfaces inside the shell are referred to as more "proximal" while surfaces that extend through the shell are referred to as "distal." A proximal side of a jet faces the spa shell where the user relaxes, and the jet can provide hydrotherapy to the user in the spa.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A spa waterfall lighting system comprising:

a waterfall body with a base portion and a top portion, an inlet for receiving water and an outlet for dispersing water into a spa shell cavity, the waterfall body further comprising a wired light located within the waterfall body;

a projection in connection with the base portion of the waterfall body, the projection comprising a hollow interior channel in fluid communication with the inlet of the waterfall body, the projection further comprising an externally threaded portion, and a channel formed in the externally threaded portion, the channel for receiving a wire, the wire in electrical connection with the wired light located within the waterfall body;

a threaded nut for securing the projection to a spa shell, and wherein the threaded nut is threadable over the externally threaded portion of the projection when the wire is in the channel; and a selectively removable cover to cover a portion of the top portion of the waterfall body.

2. The spa waterfall lighting system of claim 1, wherein the projection comprises a smooth barb coupling for attaching the projection to a water source.

3. The spa waterfall lighting system of claim 1, wherein the channel is open on an external side of the channel to insert the wire into the channel.

4. The spa waterfall lighting system of claim 1, wherein the channel is covered on an external side.

5. The spa waterfall lighting system of claim 1, wherein the inlet for receiving water is in fluid communication with the projection, such that water flows from the spall shell cavity, through the projection, through the inlet of the waterfall body, and to the outlet for dispersing water into the spa shell cavity.

6. The spa waterfall lighting system of claim 1, wherein the base portion of the waterfall body comprises a lighting conduit formed in a bottom side of the base portion, the lighting conduit extending upwardly from the base portion and forming a space to receive the wired light.

7. The spa waterfall lighting system of claim 1, wherein the top portion of the waterfall body forms a spillway on a top side of the top portion.

8. The spa waterfall lighting system of claim 7, wherein the top portion of the waterfall body comprises a void therethrough to allow water to pass from an interior of the waterfall body, through the void, and onto the spillway.

9. The spa waterfall lighting system of claim 8, wherein the top portion of the waterfall body comprises a plurality of voids therethrough to allow water to pass from an interior of the waterfall body, through the void, and onto the spillway, and wherein the top portion further comprises a plurality of upwardly extending dividers separating each of the plurality of voids.

10. The spa waterfall lighting system of claim 1, wherein removing the selectively removable cover exposes the waterfall body to access the waterfall body for maintenance.

11. The spa waterfall lighting system of claim 1, the projection for extending through an aperture in the spa shell, from a top side of the spa shell to a bottom side of the spa shell, to connect the waterfall body to the spa shell, and wherein the threaded nut secures the projection to the bottom side of the spa shell.

12. The spa waterfall lighting system of claim 1, wherein the projection is integral to the base portion of the waterfall body.

13. The spa waterfall lighting system of claim 1, further comprising the wire, the wire extending from the wired light, through the channel in the externally threaded portion of the projection, and to a power source.

14. The spa waterfall lighting system of claim 1, further comprising a gasket, the gasket for placement between a bottom side of the spa shell and the threaded nut.

15. A system for attaching a wired feature to a spa shell, the system comprising:

a coupling in connection with a bottom side of a body of the wired feature, the coupling for extending through an aperture in the spa shell to connect the body of the wired feature to the spa shell;

wherein the coupling comprises an externally threaded portion, and a channel formed in the externally threaded portion, the channel for receiving a wire, the wire in electrical connection a wired element located within the body of the wired feature; and a threaded nut for securing the coupling to the bottom side of the spa shell, and wherein the threaded nut is threadable over the externally threaded portion of the coupling when the wire is in the channel.

16. The system of claim 15, wherein the wired element comprises at least one of a wired light, a wired user interface, and a wired display.

17. The system of claim 15, wherein the coupling is integral to the body of the wired feature.

18. A spa waterfall lighting system comprising:

a waterfall body with a base portion and a top portion, an inlet for receiving water and an outlet for dispersing water into a spa shell cavity, wherein the top portion of the waterfall body forms a spillway on a top side of the top portion, the top portion of the waterfall body further comprising a void therethrough to allow water to pass from an interior of the waterfall body, through the void, and onto the spillway; and a selectively removable cover to cover a portion of the top portion of the waterfall body, wherein removing the selectively removable cover exposes the void to allow a user to service the spa waterfall lighting system.

19. The spa waterfall lighting system of claim 18, wherein the waterfall body further comprises a projection in connection with the base portion of the waterfall body, the projection comprising a hollow lumen in fluid communication with the inlet of the waterfall body, the projection further comprising an externally threaded portion, and a channel formed in the externally threaded portion, the channel for receiving a wire, the wire in electrical connection with a wired light located within the waterfall body; and a threaded nut for securing the projection to a spa shell, and wherein the threaded nut is threadable over the externally threaded portion of the projection when the wire is in the channel.

20. A method of providing a wired connection to a light within a waterfall feature, the method comprising:

providing the waterfall feature, the waterfall feature comprising:

a waterfall body with an inlet for receiving water and an outlet for dispersing water into a spa shell cavity, the waterfall body further comprising a wired light located within the waterfall body;

the waterfall body further comprises a coupling in fluid communication with the waterfall body, the coupling for receiving water therethrough; and the coupling having an externally threaded portion, and a channel formed in the externally threaded portion, the channel for receiving a wire, the wire in electrical connection with the wired light located within the waterfall body;

placing the wire through the channel, from a power source to the wired light;

placing the coupling through a void in a spa shell; and securing a threaded nut for over the externally threaded portion of the coupling when the wire is in the channel.

* * * * *